US008293696B2

(12) United States Patent
McLaren et al.

(10) Patent No.: US 8,293,696 B2
(45) Date of Patent: Oct. 23, 2012

(54) ALKALINE COMPOSITION COMPRISING A CHELANT MIXTURE, INCLUDING HEIDA, AND METHOD OF PRODUCING SAME

(75) Inventors: Kevin P. McLaren, Plainfield, IL (US); Joseph C. Drozd, Park Ridge, IL (US); Gordon Renn, Lyons, IL (US)

(73) Assignee: Ecolab, Inc., Eagan, MN (US)

( * ) Notice: Subject to any disclaimer, the term of this patent is extended or adjusted under 35 U.S.C. 154(b) by 59 days.

(21) Appl. No.: 12/322,856

(22) Filed: Feb. 6, 2009

(65) Prior Publication Data

US 2010/0204082 A1 Aug. 12, 2010

(51) Int. Cl.
*C11D 7/06* (2006.01)
*C11D 3/33* (2006.01)

(52) U.S. Cl. ..... 510/339; 510/276; 510/318; 510/361; 510/398; 510/434; 510/477; 510/480

(58) Field of Classification Search ..... 510/276, 510/318, 339, 361, 398, 434, 477, 480
See application file for complete search history.

(56) References Cited

U.S. PATENT DOCUMENTS 3,940,341 A 2/1976 Gray et al.
3,950,276 A 4/1976 Grand
4,081,030 A 3/1978 Carpenter et al.
4,116,896 A 9/1978 Garrett et al.
4,212,994 A 7/1980 Wilson et al.
4,312,815 A 1/1982 Wilson et al.
4,363,673 A 12/1982 Settineri et al.
4,521,332 A * 6/1985 Milora ..... 510/272
4,676,920 A 6/1987 Culshaw
4,708,854 A 11/1987 Grinstead
4,769,172 A 9/1988 Siklosi
4,778,664 A 10/1988 Grinstead
4,910,002 A 3/1990 Grinstead
4,941,926 A 7/1990 Nakajima
5,049,493 A 9/1991 Khosla et al.
5,057,191 A * 10/1991 Kurematsu et al. ..... 203/3
5,149,618 A 9/1992 Tappe et al.
5,208,369 A 5/1993 Crump et al.
5,254,290 A 10/1993 Blandiaux et al.
5,258,141 A 11/1993 Crump et al.
5,389,594 A 2/1995 Crump et al.
5,447,575 A 9/1995 Crump et al.
5,565,138 A 10/1996 Klaunzer et al.
5,597,702 A 1/1997 Wong et al.
5,726,341 A 3/1998 Athey et al.
5,817,613 A 10/1998 Athey et al.
5,821,074 A 10/1998 Wong et al.
5,919,272 A 7/1999 Nielsen
5,972,868 A 10/1999 Athey et al.
6,160,194 A 12/2000 Pignatello
6,319,328 B1 11/2001 Greenberg et al.
6,436,880 B1 8/2002 Frenier
6,450,260 B1 9/2002 James et al.
6,451,224 B1 9/2002 Wilson
6,555,706 B2 4/2003 Berk et al.
6,569,814 B1 5/2003 Brady et al.
6,602,304 B2 8/2003 Jung et al.
RE38,262 E * 10/2003 Rolando et al. ..... 134/25.2
6,631,764 B2 10/2003 Parlar et al.
6,706,769 B2 3/2004 Crews
6,733,553 B2 5/2004 Kido et al.
6,749,022 B1 6/2004 Fredd
6,762,154 B2 7/2004 Lungwitz et al.
6,806,236 B2 10/2004 Frenier et al.
6,838,292 B1 1/2005 Rajan et al.
6,924,255 B2 8/2005 Chang et al.
6,929,070 B2 8/2005 Fu et al.
6,978,838 B2 12/2005 Parlar et al.
7,028,775 B2 4/2006 Fu et al.
7,048,906 B2 5/2006 Lin et al.
7,064,235 B2 6/2006 Berk et al.
7,078,370 B2 7/2006 Crews
7,114,567 B2 10/2006 Chan et al.
7,165,613 B2 1/2007 Chan et al.
7,192,908 B2 3/2007 Frenier et al.
7,256,160 B2 8/2007 Crews
7,303,012 B2 12/2007 Chan et al.
7,306,041 B2 12/2007 Milne et al.
7,314,857 B2 1/2008 Madhyastha
7,319,149 B2 1/2008 Liu
7,354,604 B2 4/2008 Ramirez et al.
7,368,492 B2 5/2008 Foo et al.
7,380,602 B2 6/2008 Brady et al.
7,419,004 B2 9/2008 Salamat
7,427,584 B2 9/2008 Frenier et al.
7,431,089 B1 10/2008 Couillet et al.
2002/0002983 A1 1/2002 Greenberg et al.
2003/0176305 A1* 9/2003 Hoyt et al. ..... 510/245
2004/0009880 A1 1/2004 Fu
2004/0014606 A1 1/2004 Parlar et al.
2005/0049181 A1 3/2005 Madhyastha
2008/0182761 A1 7/2008 Stephenson et al.
2008/0228240 A1 9/2008 Edell et al.
2008/0280806 A1* 11/2008 Bartelme et al. ..... 510/446
2008/0314409 A1 12/2008 Theyssen et al.
2009/0099058 A1 4/2009 Crump et al.
2009/0163389 A1 6/2009 De Campo et al.
2009/0176688 A1* 7/2009 Tjelta et al. ..... 510/445
2009/0264329 A1* 10/2009 Underwood et al. ..... 510/109

(Continued)

FOREIGN PATENT DOCUMENTS

WO WO 89/03883 5/1989

(Continued)

*Primary Examiner* — Charles Boyer

(74) *Attorney, Agent, or Firm* — Stout, Uxa, Buyan & Mullins; Frank J. Uxa

(57) ABSTRACT

Compositions, such as alkali builder compositions for the laundry industry, are provided and include water, an alkali metal hydroxide component, a chelating component and a hydroxyethyliminodiacetic acid (HEIDA) component. Methods for producing such compositions are also disclosed.

17 Claims, No Drawings

U.S. PATENT DOCUMENTS

| | | | | |
|---|---|---|---|---|
| 2005/0139354 | A1 | 6/2005 | Salamat | |
| 2005/0153859 | A1 | 7/2005 | Gohl et al. | |
| 2005/0169962 | A1 | 8/2005 | Bhatia et al. | |
| 2005/0255172 | A1* | 11/2005 | Omidbakhsh | 424/616 |
| 2006/0058197 | A1 | 3/2006 | Brown et al. | |
| 2006/0102349 | A1 | 5/2006 | Brady et al. | |
| 2006/0111265 | A1* | 5/2006 | Rypkema et al. | 510/504 |
| 2006/0155145 | A1 | 7/2006 | Pombeiro et al. | |
| 2006/0269495 | A1* | 11/2006 | Popp et al. | 424/70.1 |
| 2007/0235189 | A1 | 10/2007 | Milne et al. | |
| 2008/0108539 | A1 | 5/2008 | Kany et al. | |
| 2008/0139412 | A1 | 6/2008 | Fuller | |

FOREIGN PATENT DOCUMENTS

| | | |
|---|---|---|
| WO | WO 91/06641 | 5/1991 |
| WO | WO 91/06700 | 5/1991 |
| WO | WO 91/19040 | 12/1991 |
| WO | WO 93/25697 | 12/1993 |
| WO | WO 95/17679 | 6/1995 |
| WO | WO 97/21669 | 6/1997 |
| WO | WO 98/32830 | 7/1998 |
| WO | WO 00/12463 | 3/2000 |
| WO | WO 00/63422 | 10/2000 |
| WO | WO 01/61148 | 8/2001 |
| WO | WO 01/87827 | 11/2001 |
| WO | WO 02/24831 | 3/2002 |
| WO | WO 02/083926 | 10/2002 |
| WO | WO 02/092905 | 11/2002 |
| WO | WO 02/100478 | 12/2002 |
| WO | WO 03/025340 | 3/2003 |
| WO | WO 03/029613 | 4/2003 |
| WO | WO 2004/045281 | 6/2004 |
| WO | WO 2004/053224 | 6/2004 |
| WO | WO 2005/016270 | 2/2005 |
| WO | WO 2005/110090 | 11/2005 |
| WO | WO 2005/121273 | 12/2005 |
| WO | WO 2006/029188 | 3/2006 |
| WO | WO 2006/030397 | 3/2006 |
| WO | WO 2006/041822 | 4/2006 |
| WO | WO 2006/052369 | 5/2006 |
| WO | WO 2006/052578 | 5/2006 |
| WO | WO 2006/063155 | 6/2006 |
| WO | WO 2006/071663 | 7/2006 |
| WO | WO 2007/030435 | 3/2007 |
| WO | WO 2007/059194 | 5/2007 |
| WO | WO 2007/080187 | 7/2007 |
| WO | WO 2007/125101 | 11/2007 |
| WO | WO 2007/128745 | 11/2007 |
| WO | WO 2007/140282 | 12/2007 |
| WO | WO 2008/003779 | 1/2008 |
| WO | WO 2008/028896 | 3/2008 |
| WO | WO 2008/071746 | 6/2008 |
| WO | WO 2008/081943 | 7/2008 |

* cited by examiner

ALKALINE COMPOSITION COMPRISING A CHELANT MIXTURE, INCLUDING HEIDA, AND METHOD OF PRODUCING SAME

BACKGROUND OF THE INVENTION

The present invention relates to compositions which include water, alkali metal hydroxide components, and chelating components, and to methods of producing such compositions. More particularly, the present invention relates to compositions, for example, solutions, comprising water, alkali metal hydroxide components and chelating components which have increased solubility or storage stability, and to methods of producing such compositions.

Highly alkaline liquid compositions including one or more chelating agents are commercially useful. For example, such compositions are useful as alkali builders in the laundry industry. However, such chelating component-containing, alkaline compositions, for example, made alkaline by an alkali metal hydroxide component, such as sodium hydroxide, tend to produce crystals or other solid materials, for example, crystals including the chelating component, in the compositions after a period of storage. It is desirable, in a number of applications, that these alkaline compositions be provided for use as liquid solutions, that is without containing crystals and/or other solid materials. Thus, the concentration of the alkaline metal hydroxide component and/or the chelating component in such compositions has been limited because of the limited solubility of these components in the compositions.

It is known that enhanced solubility, for example, of the chelating component, can be obtained by using a combination of sodium hydroxide and potassium hydroxide in such alkaline compositions. However, the combination of sodium hydroxide and potassium hydroxide is substantially more expensive, and therefore less attractive, than using a single alkali metal hydroxide, for example, sodium hydroxide.

Thus, there is a continuing need to provide alkaline, chelating component-containing compositions which have increased solubility so as to reduce the cost of transporting and storing the product while, at the same time, providing a very effective form, in particular a soluble form, of the composition for use by the final consumer of the composition.

SUMMARY OF THE INVENTION

New compositions, for example, concentrated alkali builder compositions for use in the laundry industry, and methods for producing such compositions have been discovered. Such compositions and methods have surprisingly been found to provide chelating component-containing, alkaline compositions with increased or enhanced solubility and/or storage stability. Such benefits are obtained cost effectively and without detrimentally affecting the usefulness of the compositions. The present compositions may remain solutions, for example, without solid material formation and/or crystal formation, and include higher concentrations of alkaline components and/or chelating components relative to prior art compositions. Thus, the present compositions are often less costly to transport and store relative to compositions which are less concentrated in alkaline components and/or chelating components.

In one broad aspect, the present invention is directed to compositions comprising water, an alkali metal hydroxide component, a chelating component, and a HEIDA component in an amount effective to increase the solubility of the chelating component in the composition relative to an identical composition without the HEIDA component. As used herein, the term "HEIDA component" refers to hydroxyethyliminodiacetic acid, for example, 2-hydroxyethyliminodiacetic acid, and salts thereof, including, without limitation, potassium, sodium, ammonium and amine salts thereof.

In one embodiment, the HEIDA component comprises a disodium salt of hydroxyethyliminodiacetic acid.

In the context of the present invention, the HEIDA component is different from the chelating component included in the present compositions.

The composition may be, and advantageously is, in the form of a liquid solution.

The water may be present in an amount effective as a solvent for the other components of the present compositions.

The water may be present in an amount of less then about 65% by weight of the composition.

The alkali metal hydroxide component may include one or more alkali metal hydroxides. Mixtures of alkali metal hydroxides may be employed, for example, combinations of sodium hydroxide and potassium hydroxide. In one embodiment, the alkali metal hydroxide component comprises sodium hydroxide.

The alkali metal hydroxide component may be present in any suitable amount. The concentration of the alkali metal hydroxide component may be relatively large, for example, to provide the composition with a desired degree of alkalinity and/or a desired functionality, for example, as an alkali builder in a laundry application or in the laundry industry, and/or to reduce the cost of shipping the composition to its final use site. For example, the alkali metal hydroxide component may comprise at least about 20% or about 25% or about 30% or about 35% or more by weight of the composition. In one embodiment, the amount of alkali metal hydroxide component in the present composition, e.g., solution, may be substantially at or near, e.g., within about 5%, of the maximum amount of the alkali metal hydroxide component which is soluble in the composition.

In one embodiment, the chelating component may be selected from the group consisting of an EDTA component, a polyacrylate component, a NTA component and mixtures thereof. In one embodiment, the chelating component comprises an EDTA component. The terms "EDTA component", "polyacrylate component" and "NTA component" are defined hereinafter.

The chelating component may be present in any suitable amount, for example, effective to provide a desired property or characteristic or functionality to the present compositions, for example, when used in combination with the presently useful alkali metal hydroxide component. In one embodiment, the chelating component is present in an amount effective in at least assisting the effectiveness or functioning of the present composition as an alkali builder or alkali builder composition in the laundry industry. In one embodiment, the chelating component is present in an amount in a range of about 0.5% to about 8% by weight of the composition.

As noted above, the HEIDA component is present in an amount effective to increase the solubility of the chelating component in the composition. The HEIDA component may be present in any suitable amount. In one embodiment, the HEIDA component is present in an amount by weight less than the amount of the chelating component. The HEIDA component may be present in an amount in a range of about 0.01% to about 2.5% or about 8% by weight of the composition.

The present composition may be such that after being stored for about 4 weeks or about 6 weeks or about 3 months or longer, at room temperature, for example, in a range of about 20° C. to about 25° C., and quiescent conditions, for example, with the composition remaining substantially still and/or substantially without stirring or agitation, and in a closed container, for example, a closed clear or opaque container, substantially no solid material, for example, no solid crystals, such as crystals of the chelating component, forms in the composition.

In another aspect of the present invention, a concentrated alkali builder composition for use in a laundry is provided which comprises water, an alkali metal hydroxide component, a chelating component, and a HEIDA component in an amount effective to increase the solubility of the chelating component in the concentrated alkali builder composition relative to an identical concentrated alkali builder composition without the HEIDA component.

In a further aspect of the present invention, methods for producing a concentrated alkali builder composition for use in a laundry are provided and comprise providing (1) liquid water, (2) an aqueous solution of an alkali metal hydroxide component, (3) an aqueous solution of a chelating component, and (4) an aqueous solution of a HEIDA component; combining (1), (2), (3) and (4) together at conditions effective to form a liquid solution comprising water, the alkali metal hydroxide component, the chelating component, and the HEIDA component in an amount effective to increase the solubility of the chelating component in the composition relative to an identical composition without the HEIDA component. The liquid solution may be stored in a closed container and/or shipped, for example, to an industrial or commercial laundry, where the composition is used, for example as an alkali builder composition.

Any feature or combination of features described herein are included within the scope of the present invention provided that the features included in any such combination are not mutually inconsistent as will be apparent from the context, this specification, and the knowledge of one of ordinary skill in the art. In addition, any feature or combination of features may be specifically excluded from any embodiment of the present invention.

DETAILED DESCRIPTION OF THE INVENTION

The present invention provides chelating component-containing, alkaline compositions which can be centrally produced, shipped to a remote application site and stored, for example at the production site and/or at the application site awaiting use, for relatively long periods of time without detrimentally affecting the form or usefulness of the compositions. Moreover, the cost of shipping the present compositions may be reduced because the compositions may be more concentrated in one or more active ingredients, for example, the chelating component, relative to prior art formulations.

It has surprisingly been found that the inclusion of a relatively minor amount of a HEIDA component into such chelating component-containing alkaline compositions increases the solubility and/or storage stability of the compositions, for example, the chelating component in the compositions, sufficiently so that the compositions can be more concentrated in alkali metal hydroxide component and/or chelating component, relative to prior art compositions, and the compositions still remain solutions, for example, without solid material or crystal formation.

The present invention may provide so called alkali builder compositions or concentrated alkali builder compositions useful and well known in the laundry industry. Such compositions are effective in controlling and/or treating the water used in a laundry operation and/or in facilitating the laundering of articles, such as clothing, bedding articles, body towels, wash towels and the like. For example, and without limitation, such compositions may be effective to control the pH or acidity/alkalinity status of the wash/rinse water in a laundry operation. Such compositions may be effective to reduce the redeposition of soil and/or other material removed from laundered articles during the laundering process.

The alkali builder composition may be separately added to water during the laundering process. In order to facilitate controlling the amount and strength (amount of active material) of the alkali builder composition added during the laundering process, it is useful that the composition be in the form of a solution rather than, for example, a liquid in which some of the active material, e.g., alkali metal hydroxide and/or chelating component, is present as a solid or precipitate, for example, crystal, phase.

The present invention provides such compositions, for example, and without limitation, alkali builder compositions, for use as solutions even after relatively long periods of storage.

The compositions of the present invention comprise water, an alkali metal hydroxide component, a chelating component, and a HEIDA component in an amount effective to increase the solubility of the chelating component in the composition relative to an identical composition without the HEIDA component.

In one embodiment, the present compositions include an alkali metal hydroxide component, and a chelating component substantially similar to the components that are present in conventionally produced and used alkali builder compositions for the laundry industry. The concentrations of the alkali metal hydroxide component and/or the chelating component may be increased in the present compositions relative to the concentration of one or both of these components in a conventional alkali builder composition. The presence of a HEIDA component in the present compositions has been found to allow for increased amounts of alkali metal hydroxide component and/or chelating component, for example relative to conventional alkali builder compositions, without resulting in solid material, e.g. crystal, formation in the composition after relatively long periods, for example, up to about 4 weeks or about 6 weeks or about 3 months or longer of storage, for example quiescent storage at room temperature in a closed clear or opaque container.

The present compositions are useful in the form of liquid solutions.

The alkali metal hydroxide component may include one or more alkali metal hydroxides. Particularly, useful alkali metal hydroxides include sodium hydroxide, potassium hydroxide and mixtures thereof. Sodium hydroxide is very useful because of its relatively low cost and high availability. The alkali metal hydroxide component may be present in the present compositions in any suitable or useful amount, for example, and without limitation, an amount suitable for use in an alkali builder composition for the laundry industry.

The concentration of the alkali metal hydroxide component in the present compositions may be relatively high, for example, so as to provide the composition with desired functionality, such as an alkali builder composition, and/or to reduce the cost of shipping the composition to its final use site. In one embodiment, the alkali metal hydroxide component may comprise at least about 20% or about 25% or more, for example, about 35%, by weight of the present composition.

Any suitable grade or source of alkali metal hydroxide component may be employed in the present compositions. For example, the alkali metal hydroxide component may be technical grade material, chemically pure grade material and the like. The alkali metal hydroxide component should be such as to be effectively used in the application desired for the present composition.

The present compositions comprise a chelating component, for example, in a suitable amount or concentration, such as an amount or concentration useful in the use application of the composition.

In one embodiment, the chelating component in the present composition, as well as the alkali metal hydroxide component in the present composition, may be present in an amount or concentration which is increased relative to the amount or concentration of the chelating component, and the alkali metal hydroxide component, present in the final use application of the composition. In other words, the present compositions may be relatively highly concentrated in the amount or concentration of chelating component and alkali metal hydroxide component so that the composition, in its final use application, can be used without dilution or can be combined with water or an aqueous composition to provide an effective concentration of chelating component and alkali metal hydroxide component useful in the final use application.

In one embodiment, the chelating component comprises an aminopolycarboxylic acid chelating component or agent selected from ethylenediamine tetraacetic acid (EDTA) hydroxyethyl ethylene diamine triacetic acid (HEDTA), diethylenetriamine pentaacetic acid (DTPA), nitrilotriacetic acid (NTA), and the potassium, sodium, ammonium and amine salts thereof, and the like and mixtures thereof. In addition, the chelating component may comprise a polyacrylate component, such as water soluble polyacrylates, and potassium, sodium, ammonium and amine salts thereof and the like and mixtures thereof. The polyacrylate component may be used alone or in combination with one or more other chelating agents, for example, as disclosed herein. Other useful chelating agents may be included alone or in combination with the chelating agents noted above in the present chelating component.

In a very useful embodiment, the present compositions comprise a chelating component selected from an EDTA component, a polyacrylate component, a NTA component and mixtures thereof.

The chelating component may include the HEIDA component and one or more chelating agents, as set forth elsewhere herein. In one embodiment, the chelating component is other than the HEIDA component. The chelating component may be present in any suitable amount or concentration, for example, effective to provide a desired property or characteristic or functionality to the present compositions, when used in combination with the presently useful alkali metal hydroxide component. The chelating component may be present in an amount effective in at least assisting in the effectiveness and/or functioning of the present compositions as an alkali builder in the laundry industry. For example, the chelating component may be present in an amount effective to reduce redeposition of material previously removed from a laundered article during the laundering operation relative to an identical alkali builder composition including no chelating component.

In one embodiment, the chelating component is present in an amount in a range of about 0.5% to about 8% by weight of the composition. However, other concentrations of chelating component are included within the scope of the present invention.

As noted previously, because of the presence of the HEIDA component, increased amounts or concentrations of the chelating component may be included in the present compositions without resulting in solid material or crystal formation after relatively long periods of storage relative to an identical composition without the HEIDA component. In other words, the presence of the HEIDA component unexpectedly has been found to allow for the inclusion of increased amounts of concentrations of chelating component and/or alkali metal hydroxide component in the present compositions, for example, such compositions present as liquid, such as aqueous, solutions.

The HEIDA component is present in a concentration effective to increase the solubility of the chelating component in the composition. The HEIDA component may be present in the composition in an amount by weight less than, substantially equal to or greater than the amount of the chelating component. The HEIDA component may be present in the composition in any suitable amount or concentration effective to provide the increased solubility as described herein.

The HEIDA component may have some degree of chelation value. However, the HEIDA component, on a molar basis, may have a reduced or less chelation value relative to the chelating component. In other words, the HEIDA component may be a weaker or less strong chelating agent relative to the material or materials making up the chelating component, that is relative to the chelating component taken as a whole.

The ratio, for example, molar ratio, of the chelating component to the HEIDA component in the present compositions may vary widely and may be chosen to provide the desired chelating or chelation functionality to the present compositions while obtaining the improved or increased solubilities of the present compositions.

In one embodiment, it may be useful to have a weight ratio of chelating component to HEIDA component greater than about 1 to achieve the desired chelating or chelation functionality of the present compositions, for example, from the chelating component, and, at the same time, to have sufficient amounts of HEIDA present to provide for the improved or increased solubilities of the present compositions, as recited herein. Other weight ratios of chelating component to HEIDA component, for example, in a range of about 0.1 or less or about 0.5 to about 2 or about 5 or about 10 or more, may be used in the present compositions and are included within the scope of the present invention.

Put another way, the chelating component may be present to provide the chelating or chelation functionality, while the HEIDA component may be present in an amount effective to increase the solubility of the chelating component, as noted herein. Although the HEIDA component has some chelating or chelation value, the major, that is at least about 50%, or primary amount of chelating or chelation ability of the present compositions is obtained from the chelating component, which is other than the HEIDA component. Notwithstanding the above, the HEIDA component may provide a substantial amount or portion of the chelating or chelation ability of the present compositions.

In one embodiment, the amount or concentration of the HEIDA component in the present compositions is in a range of about 0.01% or less to about 1.0% or about 1.5% or about 2.5% or more by weight of the composition. Other amounts or concentrations of the HEIDA component may be used in the present compositions and are included within the scope of the present invention.

The present compositions may include one or more additional component or components effective to provide a useful or desired property or characteristic to the compositions. For example, the present compositions may include one or more additional components which are commonly or conventionally used in alkali builder compositions for the laundry industry. Such additional component or components are included within the scope of the present invention and compositions.

In one useful embodiment, the present compositions include an amine component effective in controlling or treating the laundry water into which the compositions are placed. An example, without limitation, of such an amine component is triethanolamine which may be used in an amount effective to chelate iron and reduce or eliminate rust stains. Other amines may also be included, for example, amines which remain soluble in the present compositions.

The present compositions have been found to be such that after being stored for at least about 4 weeks or at least about 6 weeks or about 3 months or longer at room temperature, for example, in a range of about 20° C. to about 25° C., and quiescent conditions, for example, with the composition remaining substantially still and/or substantially without stirring or agitation, and in a closed container, substantially no solid material or crystals form in the composition. In other words, the present compositions remain solutions after storage for relatively long periods, as noted herein.

The storage containers may be made of a material which is resistant to the active ingredients in the present compositions. For example, the containers may be lined with polymeric materials and the like which are resistant to the alkalinity and chelating or chelation value of the present compositions. Examples of materials from which such containers can be made include, without limitation, polypropylene, high density polyethylene, stainless steel, one or more other materials used in conventional containers in which caustic materials are stored and the like.

The present compositions may be prepared in accordance with the following method. This method comprises providing (1) liquid water, for example, water which has been treated to remove hardness, or soft water, (2) an aqueous solution of an alkali metal hydroxide component, (3) an aqueous solution of a chelating component, and (4) an aqueous solution of a HEIDA component. The materials identified as (1), (2), (3) and (4) are combined at conditions to form a liquid solution comprising water, the alkali metal hydroxide component, the chelating component and the HEIDA component, in an amount effective to increase the solubility of the chelating component in the composition relative to an identical composition without the HEIDA component. The conditions at which these materials are combined may include a temperature in the range of room temperature to about 50° C., in the presence of stirring for a period of time sufficient to provide a uniform liquid solution.

The liquid solution may then be cooled, if necessary, and placed in suitable containers for storage and/or transportation to a final use site, for example, a commercial or industrial laundry facility.

The following non-limiting examples illustrate certain aspects of the present invention.

COMPARATIVE EXAMPLES 1-8

A series of compositions were produced by blending together at room temperature, in different proportions as shown in the individual Example, the following materials:

(1) Water;

(2) An aqueous solution containing 38% by weight of $Na_4$ EDTA, sold under the tradename Versene 100 by Dow Chemical (Versene 100).

(3) An aqueous solution including 50% by weight of sodium polyacrylate, sold under the tradename Rhodoline 207 (RD-207) by Rhodia Corporation.

(4) An aqueous solution including 50% by weight of sodium hydroxide (50% NaOH).

(5) Triethanol amine (TEA).

All the resulting compositions were solutions, and had the following make-ups, expressed as weight fraction of each component:

EXAMPLE

| COMPONENT | 1 | 2 | 3 | 4 | 5 | 6 | 7 | 8 |
|---|---|---|---|---|---|---|---|---|
| (1) Soft water | 0.298 | 0.300 | 0.302 | 0.304 | 0.303 | 0.305 | 0.307 | 0.309 |
| (2) VERSENE 100 | 0.036 | 0.034 | 0.032 | 0.030 | 0.036 | 0.034 | 0.032 | 0.030 |
| (3) RD207 | 0.060 | 0.060 | 0.060 | 0.060 | 0.055 | 0.055 | 0.055 | 0.055 |
| (4) 50% NaOH | 0.600 | 0.600 | 0.600 | 0.600 | 0.600 | 0.600 | 0.600 | 0.600 |
| (5) TEA | 0.006 | 0.006 | 0.006 | 0.006 | 0.006 | 0.006 | 0.006 | 0.006 |

Each of these compositions was stored in a closed clear container, at room temperature and quiescent conditions, and observed periodically for evidence of solid precipitate, in particular crystal formation. After 32 days of such storage, the following observations were made:

EXAMPLE

| 1 | 2 | 3 | 4 | 5 | 6 | 7 | 8 |
|---|---|---|---|---|---|---|---|
| Crystals Had Formed | Crystals Had Formed | No Crys-tals | No Crystals | Crystals Had Formed | Crystals Had Formed | No Crystals | No Crystals |

These results indicated that increases in $Na_4$ EDTA concentration of the compositions resulted in crystal formation after 32 days of storage. For example, Compositions 1, 2, 5, and 6, which included 1.37% (38% of 3.6%) or 1.29% (38% of 3.4%) by weight of $Na_4$ EDTA, formed crystals, while compositions 3, 4, 7 and 8, which included 1.14% (38% of 3.0%) or 1.22% (38% of 3.2%) by weight of $Na_4$ EDTA, formed no crystals after 32 days of storage. Thus, with regard to Comparative Examples 1-8, it is seen that in order to maintain the chelating agent in solution after storage, for example, after 32 days of storage, the amount of chelating agent in the composition must be controlled or reduced, for example, to less than 1.29% by weight.

Highly concentrated sodium hydroxide compositions, for example, for use as alkali builders in the laundry industry, often include chelating agents, such as $Na_4$ EDTA, and advantageously remain solutions, or without precipitates or crystals, during transport and storage before use. It is also beneficial that the amount or concentration of sodium hydroxide and chelating agent, such as $Na_4$ EDTA, in such solutions be increased to reduce transportation costs per unit of active material delivered, for example, in other words, to avoid the cost of transporting water.

EXAMPLES 9-12

Another series of compositions were prepared by blending together, at room temperature, in different proportions as shown in the individual Example, the following materials:

(1), (2), (3), (4) and (5), as identified previously in Comparative Examples 1-8.

(6) A HEIDA material in the form of an aqueous solution containing 28% by weight of 2-hydroxyethyliminodiacetic acid, disodium salt, and smaller amounts of sodium hydroxyl acetate (about 0% to about 4% by weight) and sodium formate (about 0% to about 2% by weight) (HEIDA).

All the resulting compositions were solutions and had the following compositions, expressed as weight fraction of each component:

EXAMPLE

| COMPONENT | 9 | 10 | 11 | 12 |
|---|---|---|---|---|
| (1) Soft water | 0.297 | 0.293 | 0.288 | 0.278 |
| (2) VERSENE 100 | 0.036 | 0.036 | 0.036 | 0.036 |
| (3) RD207 | 0.060 | 0.060 | 0.060 | 0.060 |
| (4) 50% NaOH | 0.600 | 0.600 | 0.600 | 0.600 |
| (5) TEA | 0.006 | 0.006 | 0.006 | 0.006 |
| (6) HEIDA | 0.001 | 0.005 | 0.01 | 0.02 |

Each of these solutions was stored in a closed clear container, at room temperature and quiescent conditions, and observed for evidence of solid material, in particular, crystal, formation. After 32 days of such storage, the following observations were made:

EXAMPLE

| 9 | 10 | 11 | 12 |
|---|---|---|---|
| No Crystals | No Crystals | No Crystals | No Crystals |

These results indicated that the presence of a HEIDA material, such as component (6), enhanced the solubility, for example, the storage stability, of the compositions of Examples 9-12 after 32 days of storage even through each of these compositions included 1.37% (38% of 3.6%) by weight of $Na_4$ EDTA. The presence of the HEIDA material increased the solubility of $Na_4$ EDTA by about 12.5%.

These results are surprising and in direct contrast to the results with the compositions of Comparative Examples 1 and 5 which included 1.37% by weight of $Na_4$ EDTA and no HEIDA material and formed crystals after 32 days of storage. It should be noted that except for the presence of the HEIDA material and variations in water and $Na_4$ EDTA concentrations, the amounts or concentrations of the other components, that is components (3), (4) and (5), are the same in all of the compositions of Examples 1-12. For example, the make-ups of Compositions 1 and 9-12 are identical or substantially identical except for the amount of the HEIDA material present in compositions 9-12.

This enhanced solubility or storage stability of the compositions of Examples 9-12, which include a HEIDA material, relative to the compositions of Comparative Examples 1-8, which do not include a HEIDA material, are of substantial significance. For example, the presence of relatively low concentrations of a HEIDA material, such as, as low as about 0.03% by weight of the composition (see Composition 9), allows the inclusion of increased amounts of chelating components, such as $Na_4$ EDTA, into highly alkaline compositions which would not be soluble or stable after storage without the HEIDA material.

Such HEIDA material-containing compositions can be transported and/or stored for longer periods of time without precipitate, for example, crystal, formation. The final user of the composition is thus provided with a composition in a highly acceptable form, that is, a full strength solution including the desired degree of alkalinity and chelating effectiveness, for example, for use as desired, such as in laundry applications, even after long periods of product storage.

EXAMPLES 13 (COMPARATIVE) AND 14

Two more compositions were prepared by blending together, at room temperature, in proportions as shown in the individual Example, some or all of the materials (1), (2), (3), (4), (5) and (6) as identified previously in the earlier Examples.

Each of these compositions was a solution. These solutions had the following compositions, expressed as weight fraction of each component:

EXAMPLE

| Component | 13 (Comparative) | 14 |
|---|---|---|
| Water | 0.274 | 0.269 |
| RD207 | 0.060 | 0.060 |
| 50% NaOH | 0.600 | 0.600 |
| TEA | 0.006 | 0.006 |
| HEIDA | NONE | 0.005 |
| VERSENE 100 | 0.060 | 0.060 |

Each of these solutions was stored in a closed clear container, at room temperature and quiescent conditions, and observed periodically for evidence of crystal formation. The results of these observations were as follows:

EXAMPLE

| | 13 (Comparative) | 14 |
|---|---|---|
| On day made | CLEAR | CLEAR |
| 7 Days after | CRYSTALS | NO |
| being made | PRESENT | CRYSTALS |
| 28 Days after | CRYSTALS | NO |
| Being made | PRESENT | CRYSTALS |

These results indicated that the presence of a HEIDA material, such as component (6), even at a relatively low concentration of 0.014% (28% of 0.5%) by weight, enhanced the solubility, for example, the storage stability, of the composition even though the composition included 2.28% (38% of 6.0%) by weight of $Na_4$ EDTA.

While this invention has been described with respect to various specific examples and embodiments, it is to be understood that the invention is not limited thereto and that it can be variously practiced with the scope of the following claims.

What is claimed is:

1. A composition comprising:

water;

an alkali metal hydroxide component in an amount of at least 30% by weight of the composition;

about 0.5% to about 8% by weight of the composition of a chelating component selected from the group consisting of an EDTA component, a polyacrylate component, a NTA component and mixtures thereof; and about 0.01 to about 2.5% by weight of the composition of a HEIDA component effective to increase the solubility of the chelating component in the composition relative to an identical composition without the HEIDA component including an insoluble amount of the chelating component, the composition being in the form of a liquid solution and, after being stored for 4 weeks at room temperature and quiescent conditions, forms substantially no solid precipitate, and the weight ratio of the chelating component to the HEIDA component is greater than one.

2. The composition of claim 1, wherein the water is present in an amount of less than about 65% by weight of the composition.

3. The composition of claim 1, wherein the alkali metal hydroxide component is selected from the group consisting of sodium hydroxide, potassium hydroxide and mixtures thereof.

4. The composition of claim 1, wherein the chelating component comprises an EDTA component.

5. The composition of claim 1, wherein the HEIDA component comprises a disodium salt of 2-hydroxyethyl-iminodiacetic acid.

6. The composition of claim 1 which, after being stored for about 3 months at room temperature and quiescent conditions, forms substantially no solid precipitate.

7. A concentrated alkali builder composition for use in a laundry comprising:

water;

an alkali metal hydroxide component in an amount of at least 30% by weight of the composition;

about 0.5% to about 8% by weight of the composition of a chelating component selected from the group consisting of an EDTA component, a polyacrylate component, a NTA component and mixtures thereof; and about 0.01% to about 2.5% by weight of the composition of a HEIDA component, effective to increase the solubility of the chelating component in the concentrated alkali builder composition and increase the storage stability of the concentrated alkali builder composition relative to an identical composition without the HEIDA component including an insoluble amount of the chelating component, the composition being in the form of a liquid solution, and the weight ratio of the chelating component to the HEIDA component is greater than one, the concentrated alkali builder composition being effective when added to water in a laundry operation to control pH in the water in the laundry operation.

8. The composition of claim 7, wherein the alkali metal hydroxide component is selected from the group consisting of sodium hydroxide, potassium hydroxide and mixtures thereof.

9. The composition of claim 7, wherein the alkali metal hydroxide component comprises sodium hydroxide, and the chelating component comprises an EDTA component.

10. The composition of claim 7 which, after being stored for about 3 months at room temperature and quiescent conditions, forms substantially no solid material.

11. A method for producing a concentrated alkali builder liquid solution for use in a laundry comprising:

providing (1) liquid water, (2) an aqueous solution of an alkali metal hydroxide component, (3) an aqueous solution of a chelating component selected from the group consisting of an EDTA component, a polyacrylate component, a NTA component and mixtures thereof, and (4) an aqueous solution of a HEIDA component; and combining (1), (2), (3) and (4) together at conditions effective to produce a concentrated alkali builder liquid solution comprising water, the alkali metal hydroxide component in an amount of at least 30% by weight of the liquid solution, the chelating component in an amount about 0.5% to about 8% by weight of the liquid solution, and the HEIDA component in an amount of about 0.01% to about 2.5% by weight of the liquid solution effective to increase the solubility of the chelating component in the concentrated alkali builder liquid solution relative to an identical composition without the HEIDA component including an insoluble amount of the chelating component, and the weight ratio of the chelating component to the HEIDA component is greater than one, the concentrated alkali builder liquid solution being effective when added to water in a laundry operation to control pH in the water in the laundry operation.

12. The composition of claim 1 which consists essentially of water, the alkali metal hydroxide component, the chelating component and the HEIDA component.

13. The composition of claim 7 which further comprises an amine component in an amount effective in treating the water in a laundry operation to which the composition is added.

14. The method of claim 11, wherein the concentrated alkali builder liquid solution, after being stored for 4 weeks at room temperature and quiescent conditions, forms substantially no precipitate.

15. A method comprising adding the composition of claim 1 to water in a laundry operation to control pH in the water in the laundry operation.

16. A method comprising adding the composition of claim 7 to water in a laundry operation to control pH in the water in the laundry operation.

17. The composition of claim 1, wherein the HEIDA component is present in the composition in an amount effective to increase the storage stability of the composition relative to an identical composition without the HEIDA component including an insoluble amount of the chelating component.

* * * * *